US005527256A

United States Patent [19]

Vauchelle et al.

[11] Patent Number: 5,527,256

[45] Date of Patent: Jun. 18, 1996

[54] DEVICE FOR CONVERTING THE FUNCTION OF A CUTTING/COLLECTING CYLINDER OF A FOLDING APPARATUS

[75] Inventors: Thierry Vauchelle, Saint Just en Chaussee; Herve Henry, Creil, both of France

[73] Assignees: Heidelberg Harris S.A., France; Heidelberger Druckmeschner AG, Germany

[21] Appl. No.: 329,570

[22] Filed: Oct. 26, 1994

[30] Foreign Application Priority Data

Oct. 26, 1993 [FR] France ..... 93 12745

[51] Int. Cl.[6] ..... B65H 45/16; B41F 13/62

[52] U.S. Cl. ..... 493/424; 270/6; 270/42; 270/47; 493/428

[58] Field of Search ..... 493/422, 424, 493/425, 426, 427, 428, 429, 432, 434, 435, 471, 475, 476, 478, 479, 431; 270/6, 7, 8, 9, 10, 11, 13, 14, 15, 19, 42, 47, 48

[56] References Cited

U.S. PATENT DOCUMENTS

| | | | |
|---|---|---|---|
| 1,717,257 | 6/1929 | Rasmussen | 493/428 |
| 1,826,652 | 10/1931 | Crafts . | |
| 1,848,591 | 3/1932 | Wood . | |
| 3,460,823 | 8/1969 | Neal et al. | 270/77 |
| 3,608,889 | 9/1971 | Woessner | 493/431 |
| 3,865,361 | 2/1975 | Neal | 270/76 |
| 4,159,823 | 7/1979 | Bryer et al. | 270/21 |
| 4,190,242 | 2/1980 | Bolza-Schunemann | 270/50 |
| 4,273,320 | 6/1981 | Fujushiro | 493/431 |
| 4,368,879 | 1/1983 | Hoshi | 270/6 |
| 4,381,106 | 4/1983 | Loebach | 270/47 |
| 4,521,007 | 6/1985 | Darda | 270/47 |
| 4,648,586 | 3/1987 | Michalik | 270/50 |
| 4,892,036 | 1/1990 | Lange | 101/240 |
| 5,000,433 | 3/1991 | Prum | 270/49 |
| 5,029,829 | 7/1991 | von Hein et al. | 493/424 |
| 5,080,339 | 1/1992 | Hirahara | 270/21.1 |
| 5,088,708 | 2/1992 | Nowak | 270/47 |
| 5,096,174 | 3/1992 | Nishihara | 270/47 |
| 5,122,109 | 6/1992 | Kubota et al. | 493/431 |
| 5,201,701 | 4/1993 | Roettger et al. | 493/425 |
| 5,242,367 | 9/1993 | Marmin | 493/359 |
| 5,287,805 | 2/1994 | Fischer et al. | 270/47 |

FOREIGN PATENT DOCUMENTS

| | | |
|---|---|---|
| 222152 | 5/1987 | European Pat. Off. . |
| 1761134 | 4/1975 | Germany . |
| 382837A1 | 2/1990 | Germany . |
| 47-51740 | 12/1972 | Japan . |
| 63-185777 | 12/1988 | Japan . |

*Primary Examiner*—Jack W. Lavinder
*Assistant Examiner*—Christopher W. Day
*Attorney, Agent, or Firm*—Kenyon & Kenyon

[57] ABSTRACT

A device for converting the function of a cutting/collecting cylinder (4) of a folding apparatus for rotary printing presses is provided. The cutting/collecting cylinder is convertible from a "collect" to a "non-collect" mode of operation and vice versa. Within the cutting/collecting cylinder (4) there is placed at least one group of pins (7), the pins (7) being disposed on a pin-bearing shaft (9) which can be actuated via a cam follower (41) rolling off on a cam body (27). The cam body (27) is adjustably mounted in a side wall (25) of the folding apparatus so as to be situated opposite a face side of the cutting/collecting cylinder (4). The relationship between the circumferential speed of the cutting/collecting cylinder (4) and the cam body (27) is changeable through a second power transmission element (34) which is coaxially movable and engageable with a first power transmission element (29) having at least two engagement areas (**29*a*, 29*b***) .

12 Claims, 5 Drawing Sheets

DEVICE FOR CONVERTING THE FUNCTION OF A CUTTING/COLLECTING CYLINDER OF A FOLDING APPARATUS

FIELD OF THE INVENTION

The invention relates to a device for converting the function of a cutting/collecting cylinder of a folding apparatus for rotary printing presses, said cutting/collecting cylinder being convertible from a "collect" mode to a "non-collect" mode of operation and vice versa, with at least one group of pins being placed within said cutting/collecting cylinder, said pins being supported on a pin-bearing shaft which is actuable by a cam follower rolling off on a cam body, said cam body being adjustably mounted in the frame of the folding apparatus located opposite one face side of the cutting/collecting cylinder.

BACKGROUND OF THE INVENTION

A Japanese patent application published under No. Sho 63-185777 purports to describe a folding apparatus for a rotary printing press comprising a shaft which is turnable by means of a hand crank being attachable thereto, and on which there are arranged several couplings. By disengaging one of the couplings and operating the hand crank, the phase position of a control cam can be adjusted. After the adjustment is performed, the coupling is engaged again. With this device, the collection of products is carried out by a separate collecting cylinder which does not simultaneously carry out a cutting function.

Another folding apparatus is purportedly described in German patent application DE 38 28 372 A1. This device contains a collecting cylinder for the transport of at least two signatures. This collecting cylinder includes multiple operating devices, said operating devices, at their respective ends opposite two control cams, being respectively provided with two sensing rolls arranged side by side on a common axis. Between the two control cams, which are stationary with respect to the collecting cylinder, there is arranged a carrier supporting multiple lugs which can be brought into an active and into a passive position. In the active position, the lugs prevent a folding operation from being carried out by bracing themselves against one of the two sensing rolls of each operating device. When the lugs are in a passive position, then the sensing rolls can follow the slopes of the respective control cam and trigger folding and pin-on operations. This complicated construction, as is apparent from the figures of DE 38 28 372 A1, is only justified in large printing and gravure printing presses with as much as eight etchings on the surface of a printing unit cylinder. In the smaller folding apparatuses this mechanical input is too costly and therefore not justified.

U.S. Pat. No. 3,865,361 purports to disclose a folding cylinder with a cam at its front side. This cam is provided with several roll-off surfaces from which rolls may roll off in such a way as to be arranged side by side, thereby moving pin shafts accordingly. Conversion of the folding cylinder from the "collect" mode to the "non-collect" mode takes place through axial displacement of the cam at the common high point of the roll-off surfaces. When a construction supporting a cam is axially displaceable, the danger that play will occur during operation increases, resulting in the likelihood that the construction will swing. This makes the use of a displaceable cam problematic. Also, concerns for manufacturing costs make cams with multiple roll-off surfaces undesirable because of the additional hardening processes required for the different surfaces.

Finally, the disclosure in German Patent, No. DE 17 61 134 purportedly teaches a folding device for rotary printing presses which is convertible from a "collect" mode to a "non-collect" mode and has a controlled folding cylinder. This configuration contains a control disk with a loop-type cam groove being formed therein and with multiple diametrically opposed, inwardly oriented protrusions being arranged within said cam groove. Further, the device provides shiftable gear wheels for regulating the rotational speed of the control disk with respect to the rotational speed of the folding cylinder. The major disadvantage of this folding device is the space-consuming dimension of the shiftable gearing with its large number of straight-tooth gear wheels. In addition to the space consumption, this configuration also has a negative effect on manufacturing costs.

OBJECTS AND SUMMARY OF THE INVENTION

In view of the constructions disclosed in the prior art described herein above, an object of the present invention is to improve a device for converting the function of a cutting/collecting cylinder from a "collect" to a "non-collect" mode of operation and vice versa in a manner which requires few components, uses minimal installment space and ensures high operating safety.

The present invention provides a device for converting the function of a cutting/collecting cylinder of a folding apparatus for rotary printing presses, said cutting/collecting cylinder being convertible between a "collect" and a "non-collect" mode of operation and vice versa. In accordance with the present invention, at least one group of pins is operably disposed within said cutting/collecting cylinder. The pins are mounted on a pin-bearing shaft which is actuable by a cam follower rolling off on a cam body to move the pins between a submerged an exposed position relative to the cutting/collecting cylinder. The cam body is adjustably mounted in a side wall of the folding apparatus opposite a face side of the cutting/collecting cylinder. A first power transmission element is operably coupled to the cam body, the first power transmission element having at least two engagement areas, each engagement area corresponding to a different circumferential speed of the cam body. A second power transmission element is provided which is coaxially movable and engageable between the at least two engagement areas of the first power transmission element for controlling a relationship between a circumferential speed of the cutting/collecting cylinder and a circumferential speed of the cam body.

In accordance with an embodiment of the present invention, the first and second power transmission elements are arranged one in the other, thereby creating a compact unit in which only one power transmission element makes an axial sliding movement. Thus, the mechanism is very simple, requiring a minimum of space.

In accordance with a further embodiment of the present invention, the second power transmission element is axially displaceable on a prolongation of the shaft of the cutting/collecting cylinder. The first power transmission element contains an outer toothing serving as a first engagement area and an inner toothing serving as a second engagement area. The body of a cam is attached to the first power transmission element, such that a rotational movement of the cam body can be initiated via the first power transmission element. For this purpose, the first power transmission element is rotatably mounted on bush bearings of a side wall as well as on a bearing on the prolongation of the shaft of the cutting/collecting cylinder. In this manner, a stable three-point mounting of the first power transmission element is realized which allows the highest mechanical loads to be easily absorbed. Additionally, the three-point mounting prevents a lateral tilting of the first power transmission element on the shaft prolongation of the cutting/collecting cylinder.

A stub shaft is held in a bushing of a side wall in parallel to the shaft prolongation of the cutting/collecting cylinder, said stub shaft bearing a first and a second pinion which engage one another. The second power transmission element can be engaged with the first pinion such that the second pinion drives the exterior toothing of the first power transmission element. This state of operation reduces the rotational speed of the cam body relative to the cutting/collecting cylinder by a ratio of 1:2. Consequently, the cam body rotates with only half the speed of the cutting/collecting cylinder, so that the pin-bearing shaft of the cutting/collecting cylinder is actuated every second rotation.

When the second power transmission element is engaged with the interior toothing of the first power transmission element, the cam body and the circumferential surface of the cutting/collecting cylinder rotate with the same speed. In this configuration, the cylinder functions only as a cutting cylinder. First, a second marking applied to the outer cylindrical surface of the cutting/collecting cylinder is aligned with a first fixed marking on the side wall. Then, when the toothing engagement is established, the pins will remain in their withdrawn position during the rotation of the cylinder.

The adjustment shaft of the collecting device contains annular grooves, corresponding to the operating positions of the second power transmission element, which lock the second power transmission element in its working positions.

DETAILED DESCRIPTION OF THE DRAWINGS

Figure 1:
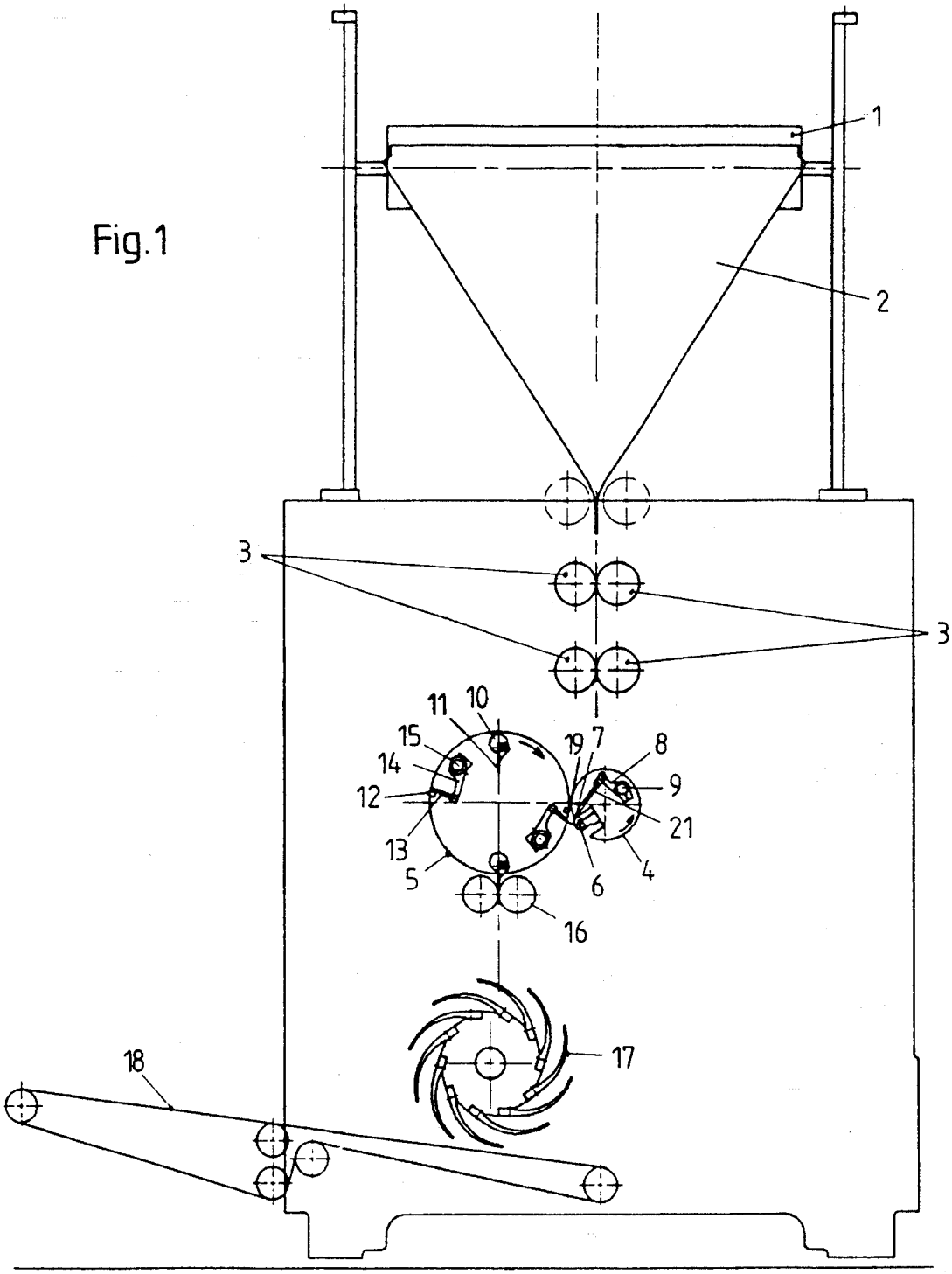
FIG. 1 is a schematic illustration of a folding apparatus including a cutting/collecting cylinder.

FIG. 1 is a schematic view of the construction of a folding apparatus, wherein a material web entering a former 2 via a former roller 1 receives a longitudinal fold. Then, the longitudinally folded material web passes between pull rollers 3 and enters a cylinder gap 19 formed between the circumferential surface of a cutting/collecting cylinder 4 and a folding cylinder 5.

The folding cylinder 5 rotates in a clockwise direction and the cutting/collecting cylinder 4 rotates in a counter-clockwise direction such that each has the same circumferential speed as the other, while they have diameters at a ratio of 2:1.

The cutting/collecting cylinder 4 has a cutting blade 6 on its outer cylindrical surface, and in the immediate vicinity of the cutting blade 6 the cutting/collecting cylinder 4 has pins 7 which are embedded in its circumference. Each of the pins 7 is fastened to the end of a respective pin socket 21, said pin sockets 21 being juxtaposed and fixed on pin levers 8 which are mounted on a pin-bearing shaft 9.

The folding cylinder 5 has a double-size diameter and is provided with folding blade shafts 10 in positions opposite one another, which respectively receive one folding blade 11. Rubber cutting anvils 12 and two groups of pins 13, located on the on the circumference of the folding cylinder 5, are arranged so as to be offset by 90°. The groups of pins 13 are each fixed to the ends of pin levers 14 which are mounted on pin-bearing shafts 15.

A pair of folding rollers 16 are located below the folding cylinder 5. The folding blade 11 pushes singular or superposed products—depending on the mode of operation of the folding apparatus—between the folding rollers 16. The products cross-folded in this way are deposited on a delivery belt 18 via a fan delivery 17.

Figure 2:
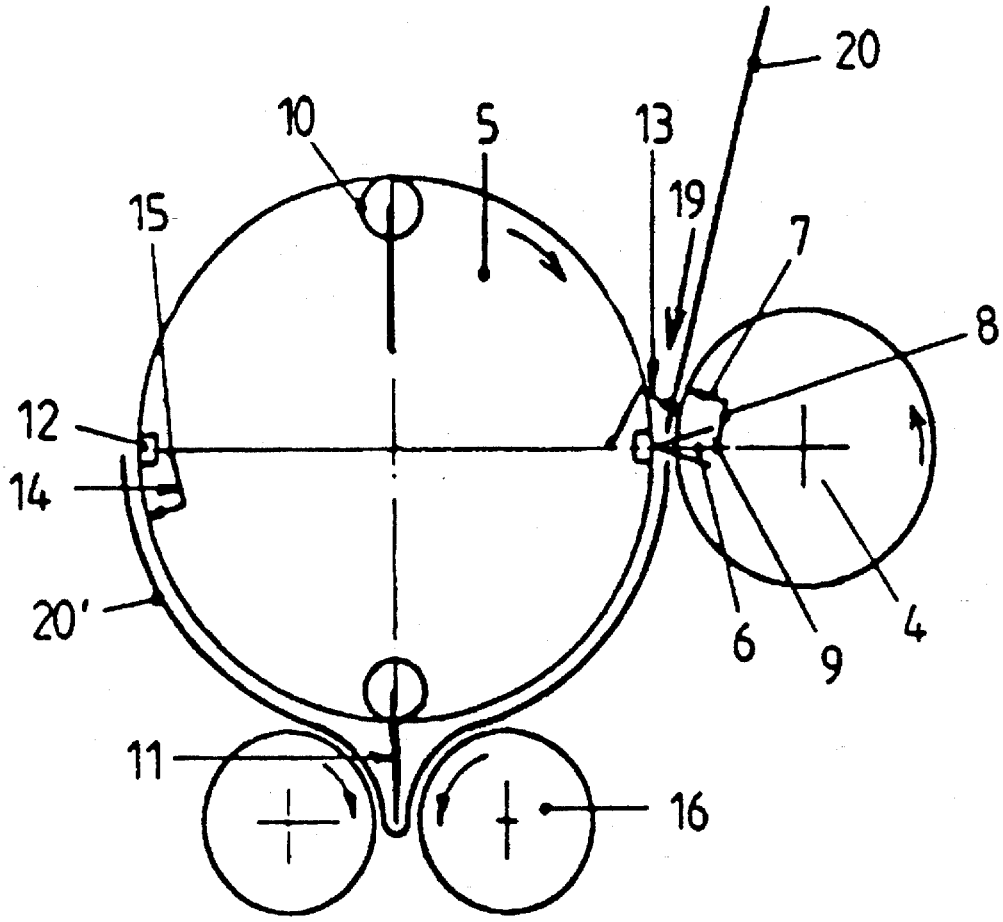
FIG. 2 is an illustration of the functioning of the cutting/collecting cylinder in the "non-collect" mode of operation.

FIG. 2 shows the functioning of the cutting/collecting cylinder 4 in the "non-collect" mode of operation. The web section 20 entering the cylinder gap 19 is gripped by pins 13 which have emerged from the folding cylinder 5 and is thereby held on the circumference of the folding cylinder 5. After the folding cylinder 5 has made one half rotation, the pins 13 submerge into the folding cylinder 5 and the cutting blade 6, in cooperation with the cutting anvil 12, cuts the web section 20 to create a separate signature 20'. The folding blade 11 mounted in the folding blade shaft 10 pushes the severed signature 20' between two folding rollers 16, and the pins 13 emerge again to grip a new arriving web section 20. In this manner the signature 20' receives an additional fold transverse to the longitudinal fold produced in the former 2. The signatures 20' then enter into the pockets of the fan delivery 17 from where they are deposited on the delivery belt 18. In this "non-collect" mode of operation, the pins 7 are inactive, remaining submerged in the circumference of the cutting/collecting cylinder 4.

Figure 3A:
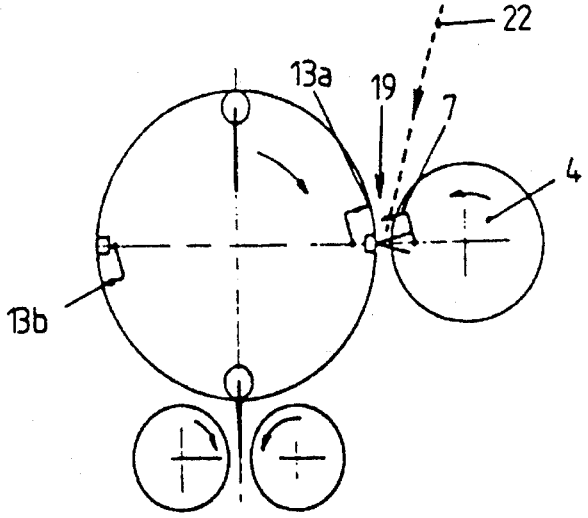
FIGS. 3*a*, 3*b*, 3*c* are illustrations of the functioning of the cutting/collecting cylinder in the "collect" mode of operation.
Figure 3B:
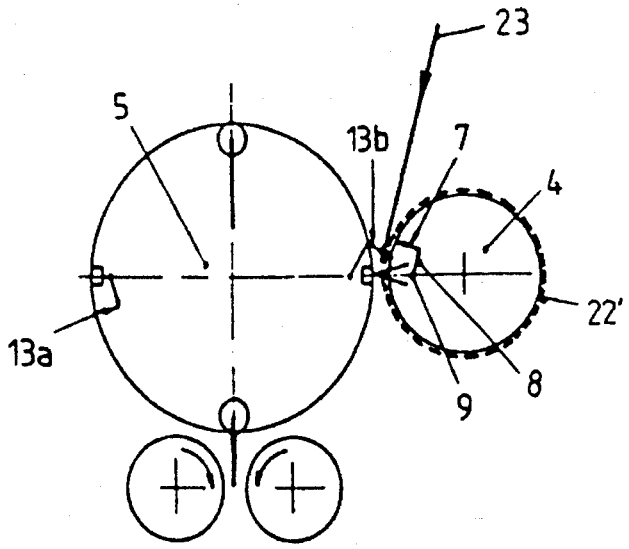
Figure 3C:
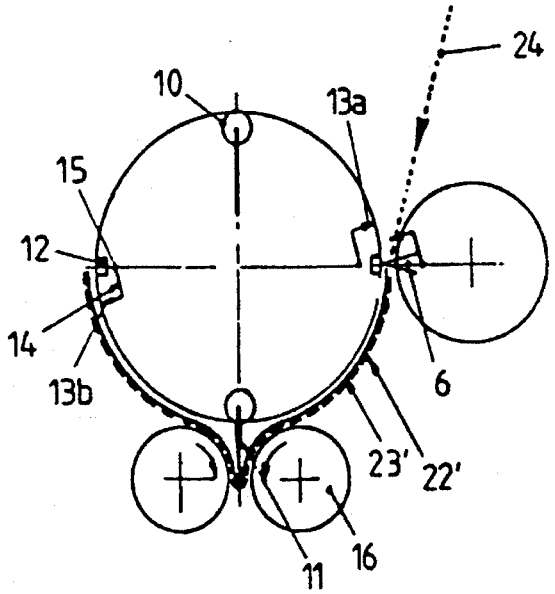

The functioning of the "collect" mode of operation is illustrated in FIGS. 3*a*, 3*b* and 3*c*. In FIG. 3*a*, a web section 22—shown here in broken lines—entering the cylinder gap 19 is gripped by emerging pins 7 on the cutting/collecting cylinder 4. Pins 13*a* and 13*b* of the double-size folding cylinder 5 remain in their submerged position.

FIG. 3*b* shows a state of operation in which the folding cylinder 5 has made one half rotation while the cutting/collection cylinder 4 has made one full rotation such that the web section 22—shown in broken lines—has come to completely lie on the circumference of the cutting/collecting cylinder 4. After cutting blade 6 severs web section 22, web section 22 is designated signature 22'. At this point in time, i.e. immediately after the cutting blade 6 has performed the cut, the pins 7, which are supported on a pin-bearing shaft 9 via pin levers 8, submerge into the circumference of the cutting/collecting cylinder 4, thereby releasing the signature 22'. Immediately thereafter the signature 22' is gripped, together with a new arriving web section 23, by emerging pins 13*b*. Through this "exchange of pins" the web section 23 and the signature 22' are held to the circumference of the folding cylinder 5 in a superposed position, until the folding cylinder 5 has made one half rotation. At that moment the web section 23 is severed by cutting blade 6 in cooperation with the cutting anvil 12, to form signature 23'. The pins 13*b* holding the signatures 22' and 23' submerge into the folding cylinder 5 before one of the folding blades 11 pushes the superposed signatures 22' and 23' into the gap between the folding rollers 16. Subsequently, a web section 24 enters into the cylinder gap 19 and is gripped by emerging pins 7 of the cutting/collecting cylinder 4 in the "collect" mode of operation.

Figure 4A:
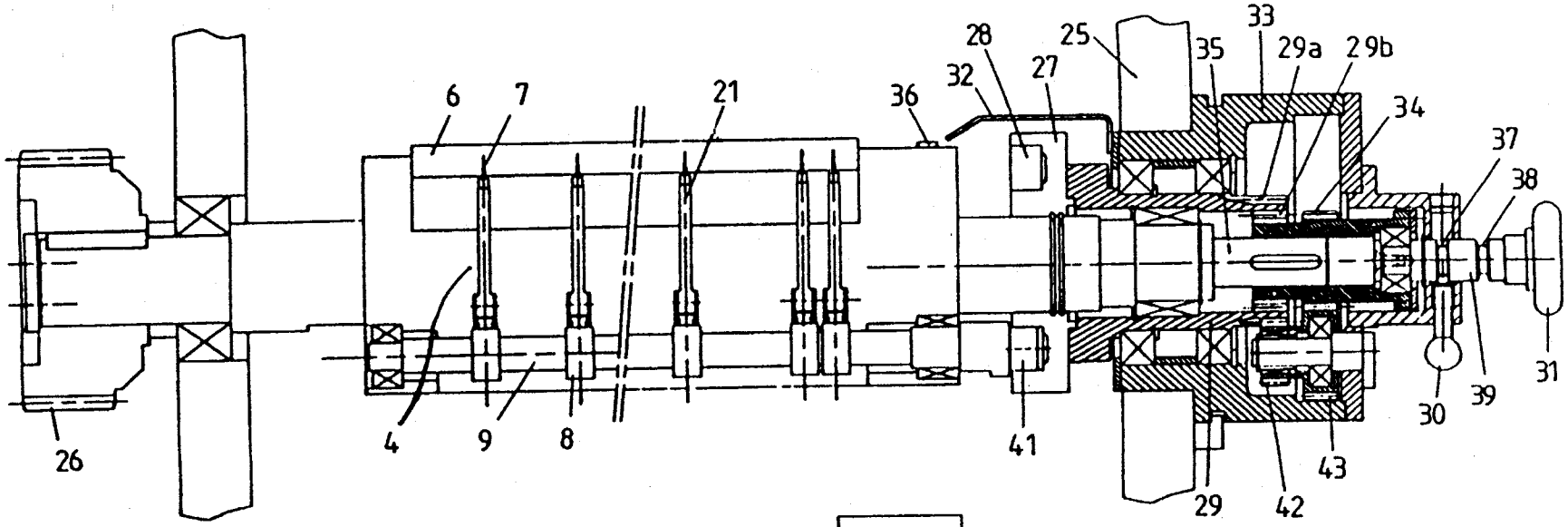
FIGS. 4*a*, 4*b* are longitudinal sections of the cutting/collecting cylinder in the "collect" mode of operation.
Figure 4B:
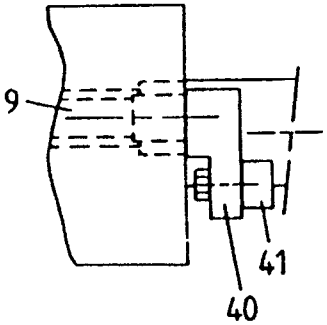

FIGS. 4*a* and 4*b* show a longitudinal section of the cutting/collecting cylinder 4 including a detail of a bearing shaft.

The cutting/collecting cylinder 4 is driven by a pinion 26 that attaches to a shaft of the cylinder 4 which also has a shaft prolongation 35. A bushing 33, which supports the first power transmission element 29 on roller bearings, is mounted in a side wall 25 of the folding apparatus. The first power transmission element 29 is simultaneously supported on a roller bearing on the shaft of the cutting/collecting cylinder 4. A cam body 27 is attached to the end of the first power transmission element 29 on the cylinder side. The cam body 27 has a grooved path 28 for receiving a cam follower 41 which activates the pin-bearing shaft 9 and thereby the pins 7, 21.

A first marking 32 which is part of the bushing 33 mounted in the side wall 25 can be brought into alignment with a second cylinder marking 36. When both marks are in conformance with one another, the pins 7 are submerged within the circumference of the cutting/collecting cylinder 4.

The first power transmission element 29 provides two engagement areas 29*a*, 29*b*, formed by an outer toothing and an inner toothing respectively. A sliding gear 34, representing the second power transmission element, is mounted on the shaft prolongation 35. The sliding gear 34 is lockable by a locking device 30 acting on two annular grooves 37, 38 of an adjustment shaft 39; and by means of a hand wheel 31 mounted on the adjustment shaft 39 at the end of the shaft prolongation 35. The sliding gear 34 is operable coaxially with respect to the first power transmission element 29. A stub shaft extends parallel to the shaft prolongation 35 and is held in the bushing 33 of the side wall. A sleeve provided with two toothings 42, 43 is disposed on the stub shaft. The sliding gear 34 is to be engaged with the toothing 43 as well as with the inner toothing 29*b* of the first power transmission element 29, while the toothing 42 continuously meshes with the outer toothing 29*a* of the first power transmission element 29.

In the state of operation shown in FIG. 4*a* the sliding gear 34 meshes with the toothing 43. Thereby, the cutting/collecting cylinder 4 introduces the drive to the toothing 43. From there the drive flows through the small-diameter toothing 42 to the outer toothing 29*a* of the first power transmission element 29 and thus into the cam body 27. As a consequence of the step-down gearing of the toothings 42, 29*a* the cam body 27 rotates at half the speed of the cutting/collecting cylinder 4, such that the pins 7 of the cylinder 4 emerge from its circumference only with every second rotation. Consequently one signature can be collected on the cylinder's circumference with every second rotation.

Figure 5A:
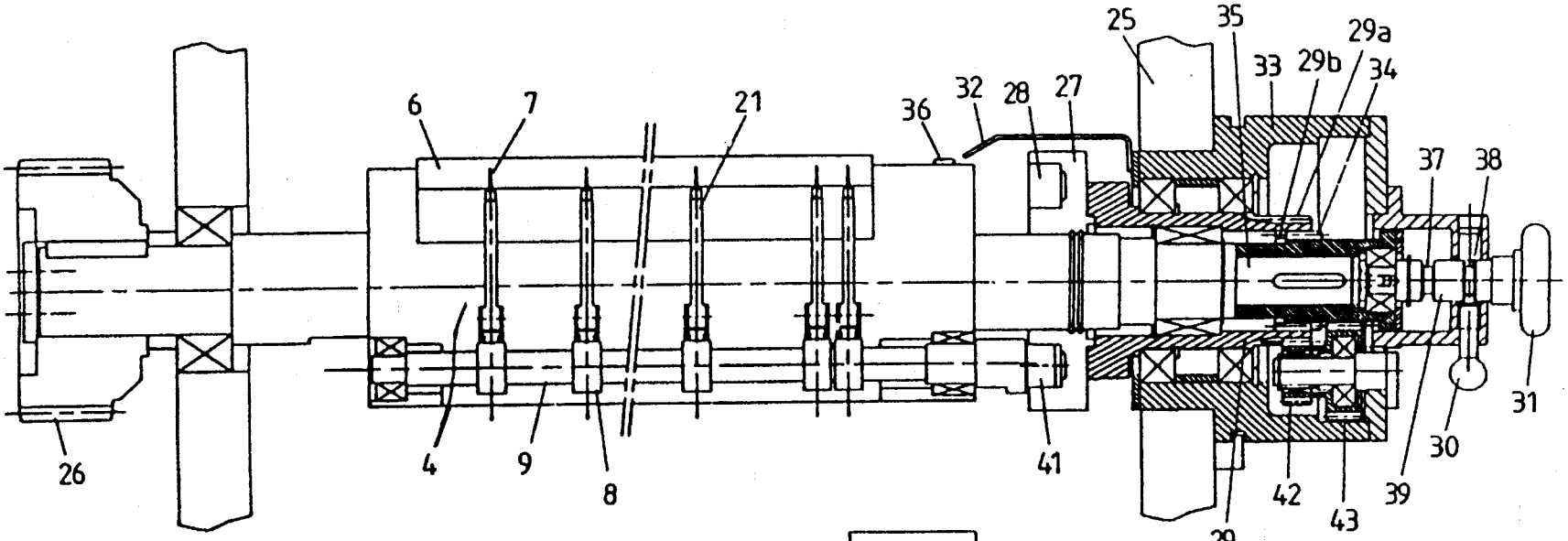
FIGS. 5*a*, 5*b* are longitudinal sections of the cutting/collecting cylinder in the "non-collect" mode of operation.
Figure 5B:
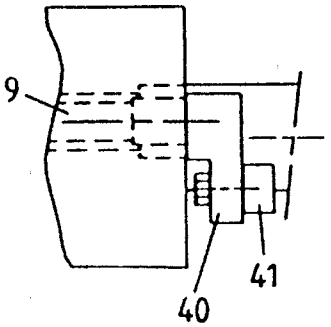

FIGS. 5*a* and 5*b* illustrate a longitudinal section of the cutting/collecting cylinder 4 in a "non-collect" mode of operation. The difference with respect to FIG. 4*a* is in the different working position of the sliding gear 34. Before changing to this mode of operation, the pins 7 are submerged into the circumference of the cutting/collecting cylinder 4, after the markings 32 and 36 have been brought to conformance. Then, the locking device 30 is actuated, and the sliding gear 34 is displaced coaxially to the first power transmission element 29 by means of the hand wheel 31 and locked in its position in that the locking device 30 engages in the annular groove 38. Now, the sliding gear 34 meshes with the inner toothing 29*b* having the same pitch diameter, which results in a gear ratio of 1. The toothings 42, 43 move along idle, the cam body 27 and the cutting/collecting cylinder 4 rotate at the same circumferential speed, thus, the pins 7 are not actuated, whereby there are no signatures collected on the circumference of the cutting/collecting cylinder 4, contrary to the mode of operation in FIG. 4*a*.

It is understood that other relationships of circumferential speed between the cutting/collecting cylinder 4 and the cam body 27 can also be realized according to the principles described herein; such relationships to be realized merely depend on the available assembly space and on the number of pin groups on a circumference, as well as on the diametric relationship between the folding cylinder 5 and the cutting/collecting cylinder 4.

What is claimed is:

1. A device for converting a function of a cutting/collecting cylinder of a folding apparatus for rotary printing presses, said cutting/collecting cylinder being convertible between a "collect" and a "non-collect" mode of operation, at least one group of pins being operably disposed within said cutting/collecting cylinder, said pins being mounted on a pin-bearing shaft in the cutting/collecting cylinder, the device comprising:

a cam follower coupled to the pin-bearing shaft for actuating the pins between a submerged and an exposed position relative to a periphery of the cutting/collecting cylinder, the cam follower rolling off on a cam body, the cam body being adjustably mounted in a side wall of the folding apparatus opposite a face side of the cutting/collecting cylinder;

a first power transmission element operably coupled to the cam body, the first power transmission element having at least two engagement areas, each engagement area corresponding to a different circumferential speed of the cam body; and a second power transmission element, the second power transmission element coaxially movable and engageable between said at least two engagement areas of said first power transmission element for controlling a relationship between a circumferential speed of the cutting/collecting cylinder and a circumferential speed of the cam body.

2. The device according to claim 1, wherein the cutting/collecting cylinder has a shaft prolongation, the second power transmission element being axially displaceable on the shaft prolongation of the cutting/collecting cylinder.

3. The device according to claim 1, wherein a first engagement area of the first power transmission element includes an outer toothing.

4. The device according to claim 1, wherein a second engagement area of the first power transmission element includes an inner toothing.

5. The device according to claim 1, wherein the cam body is attached to the first power transmission element.

6. The device according to claim 1, wherein the first power transmission element is supported on bearings of a side wall bushing.

7. The device according to claim 2, wherein the first power transmission element is rotatably mounted in a bearing on the shaft prolongation.

8. The device according to claim 1, further comprising having a first toothing and a second toothing, said stub shaft mounted in a side wall bushing fixed in the side wall, said stub shaft extending parallel to the shaft prolongation.

9. The device according to claim 8, wherein the second power transmission element can be brought into engagement with the first toothing, the second toothing meshing with an outer toothing of the first engagement area of the first power transmission element.

10. The device according to claim 8, wherein the second power transmission element can be brought into engagement with an inner toothing of the second engagement area of the first power transmission element.

11. The device according to claim 2, further comprising an adjustment shaft having annular grooves, the second power transmission element being lockable with respect to its axial position on the shaft prolongation via the annular grooves of the adjustment shaft.

12. The device according to claim 1, further comprising a first marking fixed to a bushing on the side wall, the marking being in conformance with a second marking on the circumference of the cutting/collecting cylinder when the cutting/collecting cylinder is in said non-collect mode of operation.

* * * * *